US006413044B1

(12) United States Patent
Roeloffs et al.

(10) Patent No.: US 6,413,044 B1
(45) Date of Patent: Jul. 2, 2002

(54) BLADE COOLING IN GAS TURBINE

(75) Inventors: Norman Roeloffs, Tequesta; Wesley D. Brown, Jupiter, both of FL (US)

(73) Assignee: Alstom Power N.V., Amsterdam (NL)

( * ) Notice: Subject to any disclaimer, the term of this patent is extended or adjusted under 35 U.S.C. 154(b) by 0 days.

(21) Appl. No.: 09/609,052

(22) Filed: Jun. 30, 2000

(51) Int. Cl.[7] ..... F04D 29/70
(52) U.S. Cl. ..... 415/169.1; 415/169.4
(58) Field of Search ..... 415/169.1, 169.2, 415/169.4

(56) References Cited

U.S. PATENT DOCUMENTS 3,362,155 A * 1/1968 Driscoll ..... 415/169.1
3,652,182 A * 3/1972 Deich et al. ..... 415/169.4
4,309,147 A 1/1982 Koster et al.
4,820,122 A 4/1989 Hall et al.
4,820,123 A 4/1989 Hall
4,867,634 A 9/1989 Baker et al.
4,962,640 A 10/1990 Tobery
5,222,693 A 6/1993 Slutzkin et al.
5,261,785 A * 11/1993 Williams ..... 415/169.4
5,573,370 A * 11/1996 Gray et al. ..... 415/169.4
5,837,019 A 11/1998 Endres
6,019,575 A * 2/2000 Boursy ..... 415/169.1

* cited by examiner

*Primary Examiner*—John Kwon
(74) *Attorney, Agent, or Firm*—Burns, Doane, Swecker & Mathis, L.L.P.

(57) ABSTRACT

A gas turbine whose blades are cooled with cooling air has in its turbine part a device for the removal of dirt particles from the cooling air. The device consists of a first chamber in which the cooling air is collected, and a second chamber into which the cooling air from the first chamber is fed through conduit, and in which the dirt particles are removed from the cooling air. The conduit, above which a drop in pressure occurs, are oriented at an angle (ϕ) in relation to the rotor axis so that the cooling air is accelerated in the tangential direction in relation to the rotor and moves in the circumferential direction of the rotor within the second chamber. Dirt particles are removed in the second chamber by centrifugal force from the cooling air in that they are driven outward and pass through the outlet openings into the gas stream of the turbine. The clean cooling air exits through radially further inward outlet openings into the cooling channels of the blades.

12 Claims, 2 Drawing Sheets

BLADE COOLING IN GAS TURBINE

FIELD OF THE INVENTION

The invention relates to gas turbines having guide and rotating blades that are cooled by cooling air in that the cooling air is guided through channels inside the blades. The invention relates in particular to a device for removing soil particles from the cooling stream, which prevents an obstruction of the channels in the blades.

BACKGROUND OF THE INVENTION

When building gas turbines, the durability of the blades plays a significant role. Good cooling of the blades during operation is one of the measures that ensure durability. A known method of blade cooling is air cooling, in which air is guided from the compressor of the gas turbine into the turbine part while bypassing the combustion chambers. There, the cooling air flows through channels inside the blades, whereby it cools the blades, and then enters through outlet openings into the gas stream of the turbine. A frequently occurring problem in this type of air cooling is the obstruction of these channels with dirt particles that have reached the compressor from the ambient air or that have formed inside the machine and accumulate in the channels and outlet openings of the blades because of the cooling air.

U.S. Pat. No. 4,962,640 discloses a turbine guide blade that is hollow inside, whereby it has a second, internal wall with several small, laterally arranged openings in the hollow space. The cooling air flows from the radially outer end of the blade through an opening into the hollow space, and from there through small openings to the outer blade wall, whereupon it flows from the blade into the gas stream through additional openings. In order to avoid an obstruction of the small openings in the inside wall, the radially inside end of the blade has an opening that is several times larger than the former. At this larger opening there exists a greater drop in pressure than at the small openings in the side wall of the blade so that dirt particles in the cooling air pass through this larger opening and are removed from the cooling stream. The dirt particles enter through the larger opening into a space and then through a channel into the gas stream of the turbine.

U.S. Pat. Nos. 4,820,122 and 4,820,123 disclose two additional devices for removing dirt particles from the cooling air stream of a rotating blade. The rotating blades to be cooled are provided on the inside with labyrinth-like paths for the cooling air as well as a straight path for dirt particles which leads directly to an opening at the radially outer blade end. A deflection plate is provided at each entrance to the labyrinth-like cooling air paths. In order to reach the labyrinth-like cooling channels, the cooling air must greatly change its direction by flowing around the deflection plates. While clean cooling air or air with only very light particles is able to follow this change in direction, the heavier dirt particles are unable to follow this large change in direction because of their moment of inertia. Instead, they follow a less curved path and enter the straight duct that leads to the opening for the dirt particles.

In both of these devices, the dirt particles are separated from the cooling air stream because of an abrupt change in direction. This method of separation assumes that the cooling air stream has a relatively high speed.

SUMMARY OF THE INVENTION

This invention has the objective of providing a device and a process for removing dirt particles from the cooling air stream for a gas turbine blade in which the cooling air stream has a relatively low speed.

A gas turbine in accordance with this invention has guide blades and rotating blades that are attached to the housing of the turbine or the rotor. A supply line feeds cooling air through the turbine housing into the turbine. The rotating and guide blades each have cooling channels that pass through the inside of the blades. The cooling air flows through the cooling channels whereby it cools the blades, and then enters through outlet openings into the gas stream of the turbine.

The device for removing dirt particles in the cooling air stream is arranged according to the invention on a static part of the turbine and has a first and a second chamber, whereby a channel leads from the supply line for the cooling air to the first chamber. There is at least one conduit between the first and second chamber, whereby the direction of this conduit extends at an angle between 0° and 90° to the rotor axis, whereby an angle of 0° corresponds to a parallel to the rotor axis, and an angle of 90° corresponds to a parallel to the tangent to the rotor circumference. There is also a drop in pressure from the first to the second chamber of the device, so that the cooling air is accelerated on the way from the first to the second chamber, whereby it receives a speed component in the circumferential direction of the rotor. The second chamber has two rows of outlet openings that are arranged on different radii in relation to the rotor. The first row of outlet openings is arranged radially further inside in reference to the conduit between the first to the second chamber and leads to the inlet of the cooling channels of the guide or rotating blades. The second row of outlet openings is arranged radially further outside in reference to the conduit between the first and the second chambers and feeds cooling air in the direction of the gas stream of the gas turbine.

According to the method of the invention, the cooling air is collected in the first chamber of the device according to the invention and is accelerated by a first drop in pressure from the first to the second chamber, whereby the cooling air receives a speed component in the direction of the rotor circumference. In the second chamber, dirt particles contained in the cooling air are removed by centrifugal force in that particles enter through the radially outer outlet openings from the second chamber and flow into the gas stream, and the cleaned cooling air flows through the radially inner outlet openings from the second chamber to the inlet of the cooling channels of rotating or guide blades.

The first chamber of the device according to the invention is used to collect the cooling air from the compressor in a static part of the turbine at a given pressure. The cooling air flows through the single or several conduits to the second chamber and is hereby accelerated by the drop in pressure between the two chambers, whereby it receives a speed component tangentially to the rotor circumference because of the orientation of the conduit.

The second chamber is used to separate the dirt particles from the cooling air stream by means of centrifugal force. The cooling air there flows in part tangentially to the circumference of the rotor. This tangential acceleration causes the cooling air to receive a radially outward directed speed component, so that the heavier dirt particles are driven radially outward, and the lighter and clean cooling air flows on a radially inner path. The rows of outlet openings on two different radii are used for the exit of the clean cooling air to the guide or rotating blades or the exit of the dirt particles into the gas stream. This means that the clean cooling air reaches the cooling channels of guide or rotating blades separately from the dirt particles, while the dirt particles are driven directly into the gas stream and do not reach the cooling channels.

In a first variation of the invention, the device for removing dirt particles is arranged at an inside housing part of the turbine. The first and second chambers of the device hereby each extend over the entire circumference of the turbine.

In a second variation of the invention, the device is again arranged at an inside housing part, whereby the first and second chamber each consists of several partial chambers. These partial chambers each extend over a part of the housing circumference, whereby they cover the entire circumference of the housing together.

In a third variation, the device is arranged at the radially inner end of guide blades of the turbine. First and second chambers hereby each extend over a part of the circumference of the guide blade row, for example, over four guide blades. In this case, the device again consists of several first and several second chambers or partial chambers that together cover the entire circumference of the guide blade row.

In a preferred embodiment of the invention, the number of radially inner outlet openings in the second chamber is greater than the number of radially outer outlet openings. The diameter of the radially inner outlet openings is hereby smaller than the diameter of the radially outer outlet openings, whereby the latter is at least equal to the diameter of the dirt particles to be removed. The radially outer outlet openings are not only used for the exit of dirt particles, but also the exit of a cooling air stream that flows from the radially inner parts of the turbine to the gas stream and counteracts the entrance of hot gases into the cooling channels of the rotating blades.

In another embodiment of the invention, the wall in the second chamber that is located opposite from the conduits between the two chambers is angled in the direction of the cooling air stream and radially outward. This facilitates the movement of the dirt particles in radial direction to the radially outer outlet openings.

In another embodiment, the wall in the first chamber located opposite from the conduits to the second chamber is angled in the direction of the conduits to the second chamber, so that the cooling air stream flowing into the first chamber is deflected in the direction of the conduits to the second chamber.

In yet another embodiment, there is a drop in pressure above the outlet openings for the clean cooling air from the second chamber. Because of this, the exiting clean cooling air stream is accelerated during its exit in the direction of the rotor rotation, which contributes to the optimization of the turbine power.

In another embodiment, these outlet openings are directed radially outward at an angle in relation to the flow direction within the second chamber, so that the clean cooling air stream is better able to reach the inlet to the cooling channels of the rotating blade.

BRIEF DESCRIPTION OF THE DRAWINGS

A preferred embodiment of the invention is shown in the accompanying drawings, in which.

DETAILED DESCRIPTION OF THE INVENTION

Figure 1:
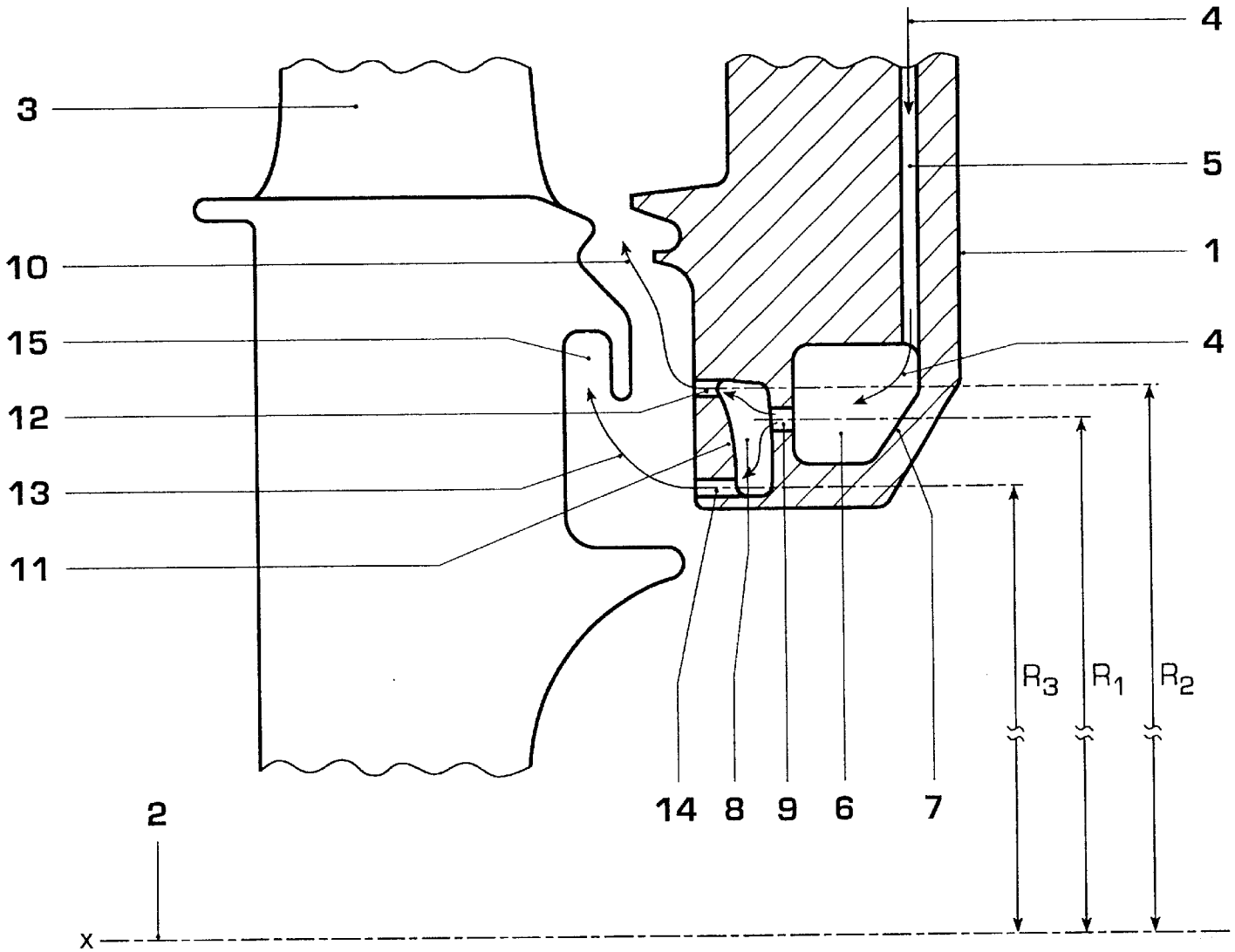
FIG. 1 is a cross-sectional view of the device according to the invention for the removal of dirt particles from the cooling air stream for rotating blades of a gas turbine.

FIG. 1 shows a device according to the invention for the removal of dirt particles from a cooling air stream for gas turbine blades. In the shown exemplary embodiment, the device is arranged on a guide blade 1 that is attached to the turbine housing (not shown). Also shown is the axis 2 of the rotor of the gas turbine that extends through the compressor, combustor and turbine part and is attached to the rotating blades, of which one rotating blade 3 is shown here.

Cooling air is removed, for example from the compressor part of the gas turbine, and is fed via a line through the turbine housings into the turbine chamber, whereby the combustor part is bypassed. Dirt particles that have entered the compressor via the ambient air or have been produced inside the machine and carried with the cooling air stream 4 are removed in the device according to the invention from the air stream, whereupon the cooling air stream is fed to the cooling channels of the rotating blade 3.

The device extends over the entire circumference of the turbine, whereby the device in the embodiment shown here consists of several partial components, of which one partial component extends, for example, over two to four guide blades.

In the turbine part, the cooling air stream 4 is fed to a channel 5 that extends longitudinally through the guide blade 1 and ends in the device according to the invention. The cooling air stream 4 first is collected in a first chamber 6 of the device and is deflected there approximately in axial direction. For this purpose, the first chamber 6 has an angled wall 7.

Figure 2:
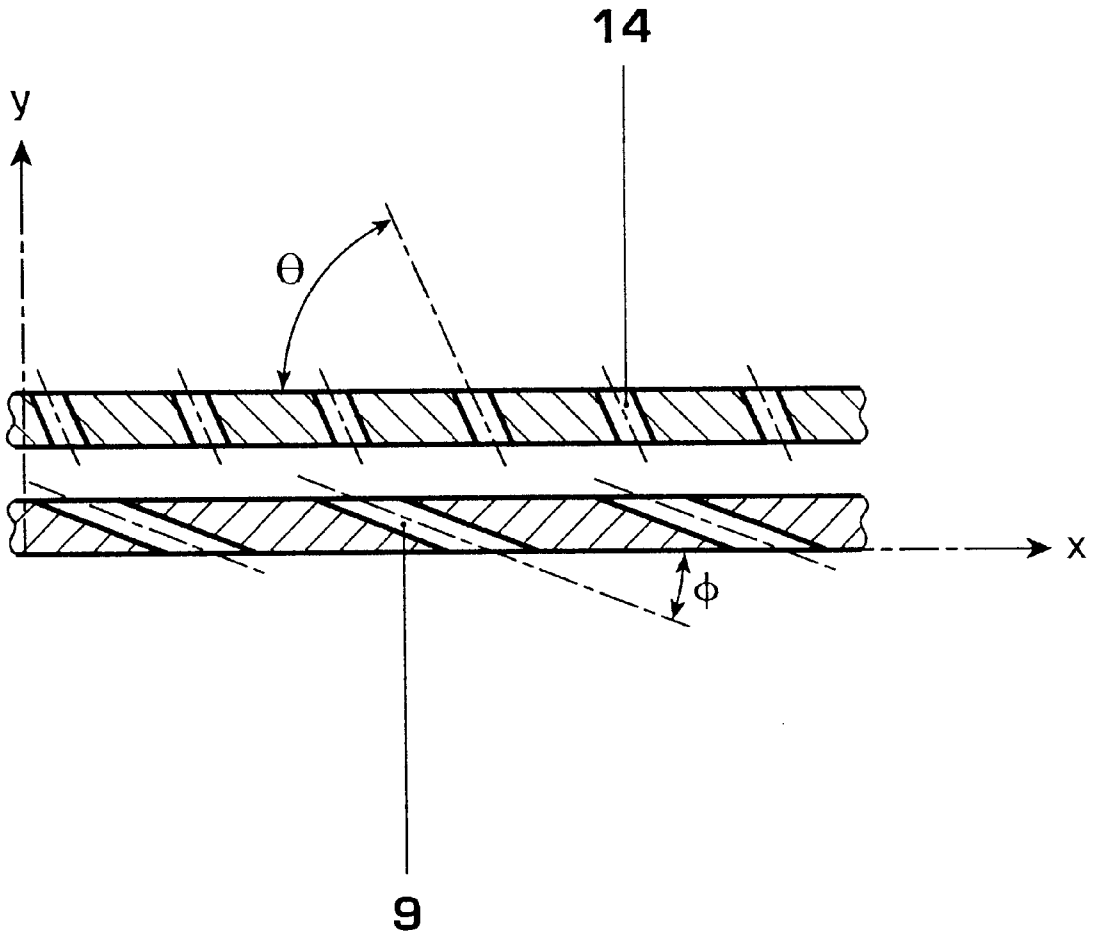
FIG. 2 is a diagram showing the arrangement of the connection openings between the two chambers of the device according to the invention as well as the outlet openings for the clean cooling air stream.

A second chamber 8 is located approximately in axial direction next to the first chamber 6. One or more openings or conduits 9 lead from the first chamber 6 to the second chamber 8. These connections 9 are aligned in respect to the rotor axis 2 at an angle that is between 0° and 90°. FIG. 2 shows a diagram of the alignment of the conduits 9. Here, the rotor axis has been designated with x, and a radial direction with y. The conduits 9 are hereby located in the plane tangential to the rotor (vertical to the x-y plane). This alignment and a drop in pressure between the first chamber 6 and second chamber 8 causes an acceleration of the cooling air stream 2 in the tangential direction in relation to the rotor. This means that within the second chamber 8 the cooling air stream (4) therefore moves in circumferential direction. As a result of this acceleration, the cooling air stream 4 receives a speed component that is directed radially outward. In the second chamber 8, a centrifugal force acts on the cooling air stream 4 and causes a separation of dirt particles from the cooling air stream 4. Cooling air 10 with heavier dirt particles flows radially outward in the second chamber. At the radially outer end of the second chamber 8, the cooling air stream with dirt particles 10 reaches one or several outlet openings 12. In the second chamber 8, the wall 11 that is located opposite from the conduit 9 is hereby angled in the direction of the outlet openings 12, so that the guidance of the cooling air stream with dirt particles towards the outlet openings is further promoted. At the outlet openings, it exits the guide blade 1 through the openings and reaches the gas stream at a point further radially outward. Within the second chamber 8, the clean cooling air 13 with no or only light dirt particles in contrast flows on a smaller radius and reaches several small outlet openings 14 at the radially inner end of the chamber. There, it exits the guide blade 1 and flows towards the inlet 15 to the cooling channels of the guide rotating blade 3. A drop in pressure above these outlet openings 14 enables a deflection and acceleration of the clean cooling air stream 13 in axial direction so that losses in turbine power are minimized.

In another variation, the outlet openings 14 are oriented at an angle in respect to the peripheral direction of the rotor. The diagram in FIG. 2 shows an example of the alignment of these outlet openings 14. The size of the angle is varied according to the design of the blade to be cooled, especially according to the alignment of the cooling channels and their inlets as well as the pressure conditions in the cooling channels.

The conduits 9 between the first chamber 6 and the second chamber 8 of the device are oriented at an angle in relation to the rotor axis 2. The size of this angle is selected based on the available drop in pressure. The greater the drop in pressure, the more the air stream can be deflected in the direction of the circumferential direction. The number and diameter of the conduits 9 furthermore are determined based on the drop in pressure between the two chambers. The conduits 9 for the cooling air stream 4 are located on a radius R1, approximately in the center of the second chamber 8. The outlet openings 12 of the second chamber for the cooling air 10 with dirt particles are arranged on a radius R2, whereby R2>R1. These outlet openings have a diameter of, for example, 2 to 3 mm, in order to allow passage of even the largest of dirt particles. These outlet openings 12 on the one hand serve to remove dirt particles. On the other hand, they also cause an air stream directed radially outward from the radially inner areas towards the gas stream, so that the stream of hot gasses into the cooling air channels of the rotating blades is prevented.

The outlet openings 14 for the clean cooling air 13 are arranged on a radius R3, whereby R3<R1. This ensures that no dirt particles are able to pass directly from the conduits 9 through the outlet openings 14 and into the cooling channels. In comparison to the openings for the dirt particles, these outlet openings 14 have a much smaller diameter but are present in much higher numbers. There are, for example, 2 to 3 outlet openings for clean cooling air for each guide blade.

What is claimed is:

1. A gas turbine having a rotor and a housing, and guide blades attached to the turbine housing, and rotating turbine blades attached to the rotor, and having a device for the removal of dirt particles from the blades, comprising:

a first chamber and a second chamber, a supply line for supplying cooling air to the first chamber, a conduit extending from the first chamber to the second chamber, whereby the direction of this conduit is oriented at an angle to the axis of the rotor, said angle being between 0° and 90°, and between the first chamber and the second chamber a drop in pressure exists, so that the cooling air is accelerated from the first chamber to the second chamber and is deflected in relation to the rotor in the tangential direction, and said cooling air flows in the second chamber with a speed component in circumferential direction of the rotor, the second chamber being provided with outlet openings for cooling air containing dirt particles and being provided with outlet openings for clean cooling air, whereby in comparison with the radial position of the conduit between the two chambers, the outlet openings for the cooling air with dirt particles are arranged further radially outward, and the outlet openings for clean cooling air are arranged further radially inward relative to the axis of the rotor, and lead to the inlets to the cooling channels of the guide or rotating blades.

2. The gas turbine as claimed in claim 1, wherein the device for the removal of dirt particles from the cooling air is arranged at an inner housing part of the turbine part.

3. The gas turbine as claimed in claim 2, wherein the first chamber and the second chamber of the device each extends over the entire circumference of the housing part.

4. The gas turbine as claimed in claim 3, wherein the first chamber and the second chamber of the device each consists of several partial chambers, each of which extends over part of the housing circumference.

5. The gas turbine as claimed in claim 1, wherein the device for the removal of dirt particles from the cooling air is arranged at the radially inner end of guide blades, and the first chamber and second chamber of the device each consists of several partial chambers that extend over several guide blades.

6. The gas turbine as claimed in claim 1, wherein in the second chamber, the radially further inward outlet openings are present in a greater number and smaller diameter than the radially further outward outlet openings.

7. The gas turbine as claimed in claim 6, wherein in the second chamber, the wall that is located opposite from the conduit between the two chambers is angled in the direction of the cooling air stream with the dirt particles and the radially further outward outlet openings.

8. The gas turbine as claimed in claim 7, wherein in the first chamber of the device, the wall located opposite from the conduit to the second chamber is angled in the direction of the conduit to the second chamber.

9. The gas turbine as claimed in claim 8, wherein in the second chamber, the outlet openings for the clean cooling air are oriented radially outward at an angle in relation to the flow direction within the second chamber.

10. The gas turbine as claimed in claim 8, wherein a drop in pressure exists above the outlet openings for the clean cooling air.

11. A method for the removal of dirt particles from cooling air for blades of a gas turbine, comprising:

collecting cooling air in a first chamber, conducting cooling air from the first chamber by a drop in pressure through a conduit into a second chamber, causing the cooling air to flow in a circumferential direction relative to the rotor of the gas turbine, and driving the dirt particles contained in the cooling air radially outward by the centrifugal force there and causing the dirt particles to pass through the outlet openings into the gas stream of the turbine, and conducting the clean cooling air to the cooling channels of guide or rotating blades through outlet openings which, in relation to the conduit, are arranged radially further inward.

12. The method according to claim 11, wherein the first and second chambers are stationary, and the outlet openings are positioned opposite the rotating blades.

* * * * *